United States Patent [19]

Andreini

[11] 4,451,288

[45] May 29, 1984

[54] METHOD FOR PRODUCING LOW HYDROGEN CONTENT IN STEELS PRODUCED BY SUBSURFACE PNEUMATIC REFINING

[75] Inventor: Rockne J. Andreini, Redmond, Wash.

[73] Assignee: Union Carbide Corporation, Danbury, Conn.

[21] Appl. No.: 393,467

[22] Filed: Jun. 29, 1982

[51] Int. Cl.[3] ..... C21C 7/00

[52] U.S. Cl. ..... 75/60; 75/59

[58] Field of Search ..... 75/59, 60

[56] References Cited

U.S. PATENT DOCUMENTS 3,046,107 7/1962 Nelson ..... 75/60

3,649,246 3/1972 Fulton ..... 75/60

*Primary Examiner*—Peter D. Rosenberg

*Attorney, Agent, or Firm*—Stanley Ktorides

[57] ABSTRACT

The production of low hydrogen steel is achieved in subsurface pneumatic refining processes by proper melt practice ensuring adequate gas sparging during the overall refining sequences, minimal time delays in the latter stages of refining, and proper control of the vessel off-gas.

11 Claims, No Drawings

METHOD FOR PRODUCING LOW HYDROGEN CONTENT IN STEELS PRODUCED BY SUBSURFACE PNEUMATIC REFINING

DESCRIPTION

TECHNICAL FIELD

This invention relates to the refining of steel, and specifically, to the subsurface pneumatic refining of steels which require a hydrogen content sufficiently low to avoid hydrogen-related internal cracking in the material produced.

BACKGROUND ART

The term "subsurface pneumatic refining," as used in the present application, is intended to mean a process by which decarburization of the melt is achieved by subsurface injection of oxygen, alone or in combination with one or more gases selected from the group consisting of ammonia, methane (or another hydrocarbon), carbon monoxide, carbon dioxide, nitrogen, argon, or steam.

Several subsurface pneumatic steel refining processes are known in the art: the AOD, CLU, OBM, Q-BOP, and LWS process are examples. A collection of U.S. patents relating to these processes are U.S. Pat. Nos. 3,252,790; 3,867,135; 3,706,549; 3,930,843 and 3,844,768, respectively. Subsurface pneumatic refining generally includes a multitude of individual processing steps, including decarburization, deoxidation, desulfurization, and degassing. Degassing is of primary interest in the present invention.

The present invention is applicable to all of the above-mentioned subsurface pneumatic steel refining processes, but, for purposes of convenience, the invention will be described by reference to the argon-oxygen decarburization process, commonly referred to as the "AOD" process.

The AOD process, as used in the present invention, defines a process for refining molten metal contained in a refractory-lined vessel which is provided with at least one submerged tuyere. The basic operations concerning the AOD process are well known. Examples of U.S. patents which describe various aspects of critical importance include U.S. Pat. Nos. 3,252,790; 3,046,107; 3,754,894; 3,816,720; 3,867,135; 4,187,102; and 4,278,464. However, there is no existing information relative to the successful production of steel (specifically carbon and low alloy steels containing less than approximately ten percent (10%) total alloy content) with a level of hydrogen low enough to avoid internal cracking associated with the hydrogen content of the steel.

The hydrogen content of steel is extremely important from the standpoint of steel quality. Internal hydrogen-related cracks significantly adversely affect the ductility and toughness of the steel, rendering the steel substantially useless for normal applications.

A common method utilized in the steel industry to produce steel containing a hydrogen level low enough to prevent hydrogen-related cracking involves vacuum degassing of the melt. However, this method requires melt temperatures in excess of that required in AOD refining, or requires application of an external heat source to maintain satisfactory melt temperatures, thereby necessitating the use of complex equipment, which is difficult to maintain. In the AOD process, however, an acceptable method still must be used to ensure the production of steel containing a satisfactory hydrogen content.

DISCLOSURE OF INVENTION

It is an object of this invention to provide a method for the subsurface pneumatic refining of steels (such as carbon steels, low alloy steels, and tool steels) wherein the hydrogen content is kept at a sufficiently low level to substantially eliminate hydrogen-related internal cracking of the product.

In general terms, the invention is a process for the production of steel involving the charging of a steel melt into a refining vessel by which the injection of gas into the melt is accomplished by using at least one submerged tuyere; the injected gas being used initially to elevate the melt temperature through reaction with added "fuel" elements (e.g., aluminum and/or silicon) and to decarburize the melt with gas mixtures of oxygen and dilution gas; the decarburizing step being followed by at least one process step characterized by the injection of essentially oxygen-free gas (e.g., Ar or $N_2$) into the melt, whereby steel of a sufficiently low hydrogen content to prohibit hydrogen-related internal cracking is produced by the combination of critical operations and parameters. The preferred process comprises:

(a) Substantially completing all alloying additions prior to the commencement of oxygen injection into the melt;

(b) Substantially completing all of the slag-forming additions prior to the commencement of oxygen injection into the melt;

(c) Maintaining a slag composition compatible with minimizing hydrogen transfer from the slag to the melt;

(d) Decarburizing the melt to essentially its aim carbon content by injecting a quantity of oxygen sufficient to remove at least 0.35% carbon from the melt;

(e) Terminating the oxygen injection sequence of the refining cycle by decarburizing a minimum of approximately 0.10% carbon from the melt in the last oxygen injection;

(f) Maintaining a minimum of about 400 standard cubic feet per ton (SCF/ton) of steel total off-gas volume (including carbon monoxide formation) in the oxygen injection sequence of refining;

(g) Maintaining a minimum specific oxygen blow rate of about 1200 standard cubic feet per hour per ton (SCF/hr-ton) of steel during the oxygen injection sequence of refining;

(h) Injecting essentially oxygen-free gas into the melt subsequent to the oxygen injection sequence, in an amount equal to a minimum of about 200 SCF/ton of steel per percent of alloy addition(s) made during this period, at a rate such that air infiltration into the vessel is minimized;

(i) Maintaining fume-collection equipment connected with the refining vessel such that air infiltration to the vessel is minimized in the process sequence(s) described in item (h);

(j) Establishing metallurgical practice procedures such that the time period from the commencement of gas injection detailed in item (h) to tap of the heat is minimized while satisfying all parameters outlined in item (h).

BEST MODE FOR CARRYING OUT THE INVENTION

The hydrogen content of steel, particularly carbon, low alloy, and tool steel grades, is extremely important with respect to product quality. If the hydrogen content exceeds a certain critical maximum, microfissures (or cracking) may occur within the steel produced, thereby rendering it scrap material. Critical hydrogen levels which can cause internal cracking are somewhat dependent upon the specific grade of steel, the cross-section (or shape) of the part being produced, and the sulfur content of the steel. It is generally agreed that the incidence of hydrogen-related internal cracking increases with increasing carbon and nickel content in the steel, with section size, and as the sulfur content of the steel is reduced.

The absolute value of a critical maximum hydrogen content is difficult to define, since differences in sampling technique and subsequent hydrogen analysis are factors which affect the hydrogen values reported at individual locations within the steel industry. Those skilled in the art generally agree, however, that a maximum hydrogen content in the range of 1.5–2.0 ppm is required in the final product for satisfactory results. Since the hydrogen content of steels normally increases during the teeming (or pouring) operation, it would appear that any subsurface pneumatic refining method must be capable of obtaining a maximum of 1.0–1.5 ppm hydrogen prior to tap if quality problems related to hydrogen are to be avoided.

The present invention details the process parameters required to produce AOD-refined steel having a sufficiently low hydrogen content to prohibit hydrogen-related internal cracking in the final product. Several process steps and parameters are necessary for the production of steel with an acceptable hydrogen content, and must be satisfactorily accomplished to obtain the desired result.

In general, the AOD process for refining carbon, low alloy, and tool steel grades involves several readily identifiable steps, mainly: (1) elevation of the melt temperature by reaction of oxygen with some element(s) which release a large quantity of heat during oxidation (aluminum and silicon are good practical examples of this type of material); (2) decarburization of the melt, wherein carbon is removed through its reaction with oxygen; (3) reduction of the melt, wherein certain elements which may have been oxidized to the slag during steps (1) and (2) are returned to the melt by reaction with a more oxidizable substance (for example, silicon is used to revert manganese or chromium which was oxidized during steps (1) and (2); (4) desulfurization of the melt, wherein the sulfur is removed by intense slag/-metal mixing; and (5) finishing the heat, wherein final, minor adjustments in melt chemistry are made through appropriate alloy trim additions. Steps (3) and (4) frequently occur simultaneously, and, as with step (5) require the injection of an essentially oxygen-free sparging gas for the desired results to occur.

Degassing of the heat may occur in all of the above steps; however, to ensure a minimal hydrogen content in the melt at the time of tap of the heat, critical guidelines should be followed.

In a preferred process, a steel melt is charged to an essentially dry refining vessel. No preheating of the refining vessel is required, providing the refractory is dry. Preheating the vessel is desirable for other reasons, however, such as improved refractory life and more reliable process predictability relative to teeming (pouring) temperature control, and as such, is the preferred condition for the refining vessel.

It is of great importance to the successful practice of this invention that all additions that need to be made during the heat be made at the earliest possible time in the overall refining sequence. It is therefore desirable that all alloying elements (e.g., manganese, chromium, nickel, molybdenum alloys, etc.) and all slag-forming elements (e.g., aluminum, silicon, burnt lime, or dolo-lime, etc.) be added prior to the commencement of the oxygen injection sequence. All additions, but in particular slag-forming additions, provide a source of hydrogen to the melt due to the moisture they contain (either chemically or physically bound). Early addition of these materials thus ensures a maximum time for gas sparging to return the hydrogen content of the melt to a low level.

While it is true that all gases injected into the melt assist in hydrogen sparging (or removing) from the melt, the reaction of oxygen with carbon in the melt is of significant benefit because two volumes of carbon monoxide are formed for each volume of oxygen that reacts. The decarburization step thus serves as the primary means of removing hydrogen present in the melt. To ensure adequate hydrogen removal, it is desirable to inject sufficient oxygen to remove approximately 0.35% carbon from the melt, and the injection procedures should be established such that the oxygen blow terminates at essentially the aim carbon content or slightly higher. Because carbon additions may also add hydrogen to the melt, it is desirable not to add carbon to the melt after oxygen injection is terminated.

Those skilled in the art of steelmaking, and especially AOD refining of steel, know that on occasion the melt may not be at a sufficiently high temperature at the completion of the oxygen injection step to allow for the successful completion of the endothermic refining steps, i.e., reduction, desulfurization, and trim addition sequences. In this case, the melt must be reblown with oxygen for temperature, usually by adding aluminum or silicon to the melt and subsequently reacting these elements with oxygen to elevate the melt temperature. Relative to the present invention temperature reblow procedures should also include a recarburization of the melt such that a minimum of approximately 0.10% carbon can be removed from the melt after attainment of proper melt temperature by the reblow operation. Hydrogen content of the melt tends to increase during reblows, so an allowance for additional sparging of the melt must be made following the reblow for temperature.

In addition to the quantity of carbon removed during decarburization, certain critical total off-gas volume and off-gas rates should be observed for satisfactory results. A minimum of about 400 SCF/ton of steel total off-gas volume (including carbon monoxide formation) should be observed during the oxygen injection sequence (including reblows, if any) to ensure adequate sparging of the melt during this period. It is preferred that the specific oxygen blow rate be maintained at a minimum of approximately 1200 SCF/hr-ton of steel in the vessel to provide for rapid fluxing of the slag-forming materials and to minimize air infiltration into the refining vessel.

Air infiltration into the refining vessel should be minimized during all process steps, since moisture in the air (water vapor) may provide a source of hydrogen to the melt. Because the decarburization step generates a large quantity of sparging gas which exits the vessel mouth at high velocity, it is common to observe the hydrogen content of the melt being minimal at the completion of decarburization.

Following decarburization, the melt is reduced and desulfurized, and trim additions of ferroalloys are made, if necessary, to bring the melt within the desired specifications. Ideally, less than one percent (1%) of the heat weight should be added to the vessel in these steps. For the successful practice of this invention, adequate sparging gas should be injected during this period under conditions that minimize air infiltration into the vessel. It is preferred that a minimum of about 200 SCF of sparging gas per ton of steel per percent of alloy addition(s) be injected during this period.

Slag characteristics, type of fume collection equipment, and speed of the operation also have significant effects on hydrogen removal observed in the latter steps of refining.

The preferred slag chemistry should have the desired capabilities relative to sulfur capacity, etc., but be of moderate basicity such that water solubility in the slag is minimized. It is necessary to consider the overall slag chemistry (i.e., alumina, silica, lime, magnesia) to determine optimality, but a preferred slag chemistry has 10–15% $Al_2O_3$, 25–30% $SiO_2$, 40–50% CaO, and 10–15% MgO as the major constituents.

The refining equipment used to document the present invention was fitted with a close-capture hood arrangement to handle the off-gases, and it was found that swinging the hood away from the mouth of the vessel during the reduction, etc., steps resulted in less air infiltration into the vessel. This discovery implied that an accelerator-stack type of fume control system might be advantageous for AOD vessels routinely refining carbon, low alloy, or tool steel grades.

The speed of the operation during the time period from the initiation of reduction to tap of the heat is also important to the success of the current invention. It is highly desirable that the vessel not stand idle while waiting for chemistry tests, etc. Except for those operating jobs that must be performed, the heat should be sparged with gas to the maximum extent possible during this time period. As short a time as possible (preferably 15 minutes or less) should be spent in these final steps.

The following examples serve to further illustrate the invention.

EXAMPLE 1

Proper Practice without Temperature Reblows

A 76,000 lb. (34,545 Kg) heat of AISI 1042 grade steel was made in a 40-short ton (36 metric ton) AOD vessel. The heat was dephosphorized in an arc furnace with limestone and oxygen under a basic dephosphorizing slag. The heat was tapped from the furnace and bottom poured into the AOD vessel. The carbon content at tap of the furnace was about 0.85%. Approximately 600 lb. (273 Kg) of 50% FeSi, 216 lb. (98 Kg) of aluminum, and 250 lb. (114 Kg) of standard ferromanganese were precharged to the vessel. After the steel was charged, 1,600 lb. (727 Kg) of lime was added to the vessel.

The heat was then blown with an oxygen:nitrogen mixture until it was decarburized to about 0.55% carbon. The temperature at this point was 2920° F. (1605° C.), and the hydrogen content was 1.8 ppm. The heat was then decarburized to about 0.43% carbon and 516 lb. (235 Kg) of 50% FeSi was added to reduce the heat. The reduction stir was performed with the fume hood swung away from the vessel, and approximately 165 SCF/ton of steel of argon was blown at a rate of 40,000 SCF/hr. The hydrogen content at the end of reduction was 1.2 ppm. The heat was then tapped and resulted in the production of acceptable steel.

EXAMPLES 2–13

Further Documentation of Successful Procedures Described in Example 1

Various heats were made in accordance with the method of Example 1:

| Example | Steel Grade | % Carbon Removed from Melt | Finishing Step: Sparging Gas Volume Used (SCF/ton) | Hydrogen Content at Tap of AOD (ppm) |
|---|---|---|---|---|
| 2 | 1029 | 0.89 | 127 | 1.2 |
| 3 | 1029 | 0.41 | 103 | 1.3 |
| 4 | 1040 | 0.44 | 200 | 1.3 |
| 5 | 4130 | 0.45 | 237 | 1.1 |
| 6 | 4142 | 0.42 | 250 | 1.5 |
| 7 | 4142 | 0.36 | 147 | 1.4 |
| 8 | 4142 | 0.40 | 152 | 1.2 |
| 9 | 4142 | 0.98 | 360 | 1.0 |
| 10 | 8620 | 0.46 | 201 | 1.2 |
| 11 | 4340 | 0.72 | 162 | 1.3 |
| 12 | HY100 | 0.66 | 248 | 0.9 |
| 13 | JDie2 | 0.45 | 140 | 1.0 |

Notes:
(1) Specific oxygen blowrate = 1550 standard cubic feet per hour per ton

Each product was acceptable.

EXAMPLE 14

Proper Practice with Temperature Reblows

An 85,000 lb. (38,635 Kg) heat of tool steel (0.53% C) was made in a 40 short ton (36 metric ton) AOD vessel. The heat was dephosphorized in an arc furnace with limestone and oxygen under a basic dephosphorizing slag. The heat was tapped from the furnace and bottom poured into the AOD vessel. The carbon content at tap of the furnace was about 0.90%. Approximately 750 lb. (340 Kg) of 50% FeSi, 240 lb. (109 Kg) of aluminum, 540 lb. 245 Kg) of standard ferromanganese, 815 lb. (370 Kg) of charge chrome, and 20 lb. (9 Kg) of molybdenum were precharged to the vessel. After the steel was charged, 2,000 lb. (909 Kg) of lime was added to the vessel.

The heat was then blown with an oxygen:nitrogen mixture until it was decarburized to about 0.60% carbon. The temperature at this point was 2880° F. (1585° C.) which was judged too low for this particular heat at this point in the process. No hydrogen data was obtained. Because the temperature was low, 192 lb. (87 Kg) of aluminum, plus 150 lb. (68 Kg) of graphite, and 53 lb. (24 Kg) of standard ferromanganese with 66 lb. (30 Kg) of charge chrome (for chemistry adjustment), were added to the vessel. The heat was reblown with an oxygen:nitrogen mixture until sufficient oxygen was blown to remove the aluminum from the melt. The temperature at this point was 2920° F. (1605° C.), and the hydrogen content was 2.4 ppm. The carbon content of the melt was approximately 0.70%.

The heat was then blown with an oxygen:nitrogen mixture until the bath was decarburized to 0.53% carbon. About 590 lb. (268 Kg) of 50% FeSi was then immediately added and the bath stirred with argon at a rate of 40,000 SCF/hr until about 140 SCF of argon/ton of steel was injected. The fume hood was swung away from the vessel during the reduction stir. The temperature at the end of reduction was 2830° F. (1555° C.), and the hydrogen content was 1.4 ppm. The heat was tapped, and an acceptable hydrogen-level steel was obtained.

EXAMPLE 15

The Effect of Insufficient Carbon Removal, Insufficient Sparging During Reduction, and Temperature Reblows A 69,000 lb. (31,365 Kg) heat of tool steel (0.53% C) was made in a 40 short ton (36 metric ton) AOD vessel. The heat was dephosphorized in an arc furnace with limestone and oxygen under a basic dephosphorizing slag. The heat was tapped from the furnace and bottom poured into the AOD vessel. The carbon content at tap of the furnace was about 0.55%. Approximately 650 lb. (295 Kg) of 50% FeSi, 288 lb. (131 Kg) of aluminum, 235 lb. (107 Kg) of standard ferromanganese, and 505 lb. (230 Kg) of charge chrome were precharged to the vessel. After the steel was charged, 1,750 lb. (795 Kg) of lime and 150 lb. (68 Kg) of graphite were added to the vessel (to raise the carbon content to about 0.75%).

The heat was then blown with an oxygen:nitrogen mixture until it was decarburized to about 0.60% carbon. The temperature at this point was 2800° F. (1540° C.) and the hydrogen content was 2.1 ppm. The heat was reblown after adding 456 lb. (270 Kg) of aluminum and 100 lb. 45 Kg) of graphite. The temperature at the end of the reblow was 2890° F. (1590° C.); the hydrogen content, 2.4 ppm; the carbon content, 0.57%. The heat was then decarburized to 0.53% carbon, and 470 lb. (214 Kg) of 50% FeSi was added to reduce the bath. The reduction stir consisted of an argon stir of sufficient duration to result in an argon consumption of about 100 SCF/ton of steel with the hood swung away from the vessel. The hydrogen content at the end of reduction (and hence at tap of the vessel) was still 2.4 ppm. This heat contained an unacceptably high hydrogen content.

Note that the approximate quantity of carbon removed from the bath was only 0.20–0.25%, resulting in a hydrogen content of greater than 2 ppm after the initial oxygen blow; and that the aluminum reblow for temperature resulted in a 0.3 ppm increase in the hydrogen content of the steel. The argon reduction blow maintained the hydrogen value at a constant level.

EXAMPLE 16

Effect of Air Infiltration and Late Lime Additions into the Refining Vessel

A 68,000 lb. (30,909 Kg) heat of AISI 1026 grade steel was made in a 40 short ton (36 metric ton) AOD vessel. The heat was dephosphorized in an arc furnace with limestone and oxygen under a basic dephosphorizing slag. The heat was tapped from the furnace and bottom poured into the AOD vessel. The carbon content at tap of the furnace was about 0.80%. Approximately 1,250 lb. (568 Kg) of 50% FeSi, 220 lb. (100 Kg) of aluminum, and 530 lb. (241 Kg) of standard ferromanganese were precharged to the vessel. After the steel was charged, 2,400 lb. (1,091 Kg) of lime was added to the vessel.

The heat was then blown with an oxygen:nitrogen mixture until it was decarburized to about 0.24% carbon. The temperature at this point was 3090° F. (1700° C.), and the hydrogen content was 1.1 ppm. Approximately 520 lb. (236 Kg) of 50% FeSi was added to reduce the heat, which was stirred with 40,000 SCF/hr of argon with the fume hood in place above the vessel. The reduction stir consumed 122 SCF/ton of steel. The temperature at the end of reduction was 2990° F. (1645° C.), and the hydrogen content was 2.1 ppm.

The heat was too hot to tap at this point, so 300 lb. (136 Kg) of lime were added and the heat was stirred (again with the fume hood on) until an additional 135 SCF of argon/ton of steel was consumed. The hydrogen content at this point was still 2.1 ppm. The product had an unacceptably high hydrogen content.

EXAMPLE 17

Effect of Specific Oxygen Blowrate on Hydrogen Content at Tap of the Heat*

| Oxygen Blowrate (SCF/hr/ton) | Sample Size (No. Heats) | Average Hydrogen Content at AOD Tap (ppm) |
|---|---|---|
| 950 | 3 | 2.2 |
| 1250 | 2 | 1.2 |
| 1550 | 16 | 1.2 |

*Note that procedures of Example 1 remained unchanged, with exception of the oxygen blowrate.

EXAMPLE 18

The Importance of Minimal Time Delays in the Latter Stages of Refining

A 65,000 lb (29545 Kg) heat of D6B grade steel (0.46%) was made in an 40 short ton (36 metric ton) AOD vessel. The heat was dephosphorized in an arc furnace with limestone and oxygen under a basic dephosphorizing slag. The heat was tapped from the furnace and bottom poured into the AOD vessel. Approximately 850 lb (386 Kg) of 50% FeSI, 240 lb (109 Kg) of aluminum, 240 lb (109 Kg) of standard ferromanganese, and 550 lb (250 Kg) of charge chrome were precharged to the vessel. After the steel was charged, 2000 lb (909 Kg) of lime was added to the vessel. The carbon content at this point was about 1.00%. The heat was blown with an oxygen:nitrogen mixture until it was decarburized to 0.34% carbon. The temperature at this point was 3030° F. (1665° C.), and the hydrogen content was 1.2 ppm. The heat was then recarburized to 0.46% carbon, 400 lb (182 Kg) at 50% FeSi was added, and the heat was stirred with argon (about 105 SCF of Ar/ton of steel) with the fume hood swung away from the vessel. The temperature after the reduction stir was 2920° F. (1605° C.).

The tap ladle required for this heat was not prepared, thereby necessitating a delay in tapping of this heat. The heat was then reblown (for added temperature) with 70 lg (32 Kg) of aluminum using an oxygen:argon mixture. The temperature after the reblow was 2890° F. (1590° C.) and the hydrogen content was increased to 1.8 ppm. The heat was then held for an additional 45 minutes while the tap ladle was being prepared. During this delay, the hydrogen content of the steel increased to 2.4 ppm. The hydrogen content at tap of the AOD vessel was unacceptably high.

EXAMPLE 19

Effect of Finishing Process Speed on Hydrogen Content of Carbon, Low Alloy, and Tool Steels

| Average Time from Initiation of Reduction Step to Tap (min) | Sample Size (No. of Heats) | Average Hydrogen Content at AOD Tap (ppm) |
|---|---|---|
| 15 | 40 | 1.2 |
| 30 | 23 | 1.9 |

I claim:

1. A method for production of low hydrogen steel by subsurface pneumatic refining, comprising:

(a) substantially completing all alloying additions prior to the commencement of oxygen injection into the melt;

(b) substantially completing all of the slag-forming additions prior to the commencement of oxygen injection into the melt;

(c) maintaining a slag composition compatible with minimizing hydrogen transfer from the slag to the melt;

(d) decarburizing the melt to substantially its aim carbon content by injecting a quantity of oxygen sufficient to remove at least 0.35% carbon from the melt;

(e) maintaining a minimum of about 400 SCF/ton total off-gas volume (including carbon monoxide formation) during the oxygen injection sequence of refining;

(f) maintaining a minimum specific oxygen blow rate of about 1200 SCF/hr-ton of steel during the oxygen injection sequence of refining;

(g) injecting substantially oxygen-free gas into the melt subsequent to the oxygen injection sequence, at least at about 200 SCF per ton of steel per percent of alloy addition(s) made during this period, at such a rate so that air infiltration into the vessel is minimized;

(h) maintaining fume-collection equipment connected with the refining vessel such that air infiltration to the vessel during step (g) is minimized;

(i) minimizing the time period from the commencement of gas injection detailed in step (g) to tap of the heat, while still satisfying all parameters outlined in step (g).

2. The method of claim 1 wherein procedures governing heats which must be reblown for temperature include an additional decarburization of at least about 0.10% carbon from the melt as the final step in the oxygen injection sequence.

3. The method of claim 1 or 2 wherein the steel is selected from the group consisting of carbon steels, low alloy steels, and tool steels.

4. A method for production of low hydrogen steel by subsurface pneumatic refining, comprising the steps of:

(a) drying a refining vessel to remove substantially all water;

(b) charging the dried vessel with a steel melt;

(c) adding all additions to the melt prior to the oxygen blow to allow the maximum time for sparging hydrogen from the melt;

(d) decarburizing the melt of at least about 0.35% carbon by blowing oxygen into the melt at a rate of at least about 1200 SCF/hr-ton of steel;

(e) substantially preventing entry of moisture into contact with the melt during processing steps following decarburization; and (f) minimizing the time spent for the processing steps following decarburization to reduce the time for hydrogen absorption into the melt.

5. The method of claim 4 wherein the processing steps following decarburization take no more than about 15 minutes.

6. The method of claim 4, further comprising the step of maintaining the slag composition compatible with minimizing hydrogen transfer from the slag to the melt.

7. A method for production of low hydrogen steel by subsurface pneumatic refining, comprising the steps of:

(a) drying a refining vessel to remove substantially all water;

(b) charging the refining vessel with a steel melt;

(c) adding all additions to the melt as early as possible to allow the maximum time for sparging of hydrogen from the melt;

(d) decarburizing the melt of at least about 0.35% carbon by blowing oxygen on the melt to assist the hydrogen sparging by creating a suitable volume of off-gas, wherein the minimum oxygen blowrate is about 1200 SCF/hr-ton of steel;

(e) substantially preventing entry of moisture into contact with the melt during processing steps following decarburization by blowing the melt with a sparging gas to maintain the flow conditions at the vessel mouth to minimize air infiltration into the vessel; and (f) minimizing the time spent for the processing steps following decarburization to reduce the time for hydrogen absorption into the melt.

8. The method of claim 7, further comprising the step of maintaining the slag composition compatible with minimizing hydrogen transfer from the slag to the melt.

9. The method of claim 1 wherein said slag composition comprises from about 10 to 15 percent aluminum oxide, from about 25 to 30 percent silicon dioxide, from about 40 to 50 percent calcium oxide and from about 10 to 15 percent magnesium oxide.

10. The method of claim 6 wherein said slag composition comprises from about 10 to 15 percent aluminum oxide, from about 25 to 30 percent silicon dioxide, from about 40 to 50 percent calcium oxide and from about 10 to 15 percent magnesium oxide.

11. The method of claim 8 wherein said slag composition comprises from about 10 to 15 percent aluminum oxide, from about 25 to 30 percent silicon dioxide, from about 40 to 50 percent calcium oxide and from about 10 to 15 percent magnesium oxide.

* * * * *